US005518508A

United States Patent [19]

Kuehnel et al.

[11] Patent Number: 5,518,508

[45] Date of Patent: May 21, 1996

[54] CONTINUOUS DYEING OF YARNS

[75] Inventors: Gert Kuehnel, Ludwigshafen; Peter Richter, deceased, late of Limburgerhof, by Gisela Richter, legal representative; by Wolfgang Richter, legal representative, Tübingen; by Georg Richter, legal representative, Marburg; Georg Schnitzer, Weisenheim, all of Germany

[73] Assignee: BASF Aktiengesellschaft, Ludwigshafen, Germany

[21] Appl. No.: 256,340

[22] PCT Filed: Jan. 8, 1993

[86] PCT No.: PCT/EP93/00021

§ 371 Date: Jul. 13, 1994

§ 102(e) Date: Jul. 13, 1994

[87] PCT Pub. No.: WO93/14257

PCT Pub. Date: Jul. 22, 1993

[30] Foreign Application Priority Data

Jan. 17, 1992 [DE] Germany ..... 4201052.7

[51] Int. Cl.[6] ..... D06P 5/00; D06P 1/22

[52] U.S. Cl. ..... 8/502; 8/650; 8/651; 8/652; 8/653

[58] Field of Search ..... 8/502, 650–653

[56] References Cited

U.S. PATENT DOCUMENTS

| | | | |
|---|---|---|---|
| 1,399,230 | 12/1921 | Touchstone et al. | 8/502 |
| 1,652,649 | 12/1927 | Tice | 8/502 |
| 4,629,465 | 12/1986 | Hasler et al. | 8/400 |
| 5,176,715 | 1/1993 | Horn | 8/400 |

FOREIGN PATENT DOCUMENTS 364752 4/1990 European Pat. Off. .

OTHER PUBLICATIONS

M. Peter et al "Grundlagen der Textilveredlung", 1 Feb. 1991, Deutscher Fachverlag pp. 146–148, 500–502.

*Primary Examiner*—Margaret Einsmann
*Attorney, Agent, or Firm*—Oblon, Spivak, McClelland, Maier & Neustadt

[57] ABSTRACT

A continuous process for dyeing yarns with vattable dyes comprises, in continuous yarn dyeing ranges, metering an aqueous dye dispersion into the circulating chemical liquor.

8 Claims, No Drawings

CONTINUOUS DYEING OF YARNS

DESCRIPTION

It is known, in the continuous dyeing of warp yarns, to add the dye in the form of a concentrated stock vat. Customarily 4–8 dip compartments equipped with squeezeoff means are used for applying the vatted dye. Squeezing takes place between the dipping steps and the dye is oxidized by air passage.

To avoid dye depletion of the dip vats, which are usually operated with squeezeoff effects of 60–90% wet pickup, the dye is replenished from stock vats having a concentration greater than 30 g/l. In the case of dyes where the leuco form is not very soluble, such as C. I. Vat Blue 5, the stock vat concentrations used are in some instances above the solubility product of the leuco form; that is, dispersions of the leuco form are used. In industrial practice such liquors tend to give rise to problems, especially as regards color constancy.

It is an object of the present invention to avoid the problem of supersaturated or else insufficiently concentrated stock vats.

We have surprisingly found that this object is achieved when, in the continuous dyeing of yarns with vat dyes, a dye dispersion is used instead of a stock vat.

Suitable for the process of the invention are for example aqueous dispersions of vat dyes containing dyes having a vatting half-life of ≦20, preferably ≦5, minutes. To increase the rate of vatting, the dyes can be used for example in very finely divided form. Usually the dyes or preparations supplied by the renowned vat dye manufacturers are already suitable. In the case of dyes not already optimized, they can be converted into a suitable form by known methods, for example ultrasonic dispersion.

The vatting rate is essentially determined by the chemical structure, the crystallinity and crystal structure and by the particle size. For a given chemical structure, high vatting rates are obtained for example with amorphous, finely divided dyes.

A high vatting rate is desirable because it keeps the concentration of unvatted dye in the dip liquor at a low level.

Another way of limiting the concentration of unvatted dye in the dip bath is by adding the dyes via a bypass mixing tank.

According to the invention, vat dyes can be used not only individually but also in combination. In the case of combinations it is possible, in particular with dyes of different substantivities, to control the dye availability through separate metering means.

Suitable substrates for dyeing are all-cellulose yarns or cellulose-containing blend yarns which are subsequently predominantly made into denim articles.

The number of dip passages generally varies within the range from 1 to 8. Depending on the dye and the reducing agent, dyeing temperatures from 20° to 95° C. can be used.

The process of the invention produces pronounced ring dyeings as a prerequisite for the worn denim look.

Advantageously, dye dispersions and solutions containing alkali and reducing agent are added separately.

Suitable reducing agents are the compounds known for vat dyeing, for example sodium dithionite, thiourea dioxide or organic reducing agents such as hydroxyacet-one. It is also possible to use mixtures of reducing agents.

Dyes suitable for the process of the invention are in particular the compounds listed in the Colour Index as vat dyes and also vattable disperse dyes, with or without prior appropriate dispersion. Preference is given to for example C.I. Vat Blue 5 (C.I. 73065), C.I. Vat Orange 2 (C.I. 59705), C.I. Vat Blue 4 (C.I. 9800), C.I. Vat Red 32 (C.I. 71135), C.I. Vat Green 1 (C.I. 59825), C.I. Vat Green 9 (C.I. 59850) or Disperse Yellow 54 (C.I. 47020).

Details of the process according to the invention are given in the following Examples, in which parts and percentages are by weight, unless otherwise stated:

EXAMPLE 1

In 4 troughs of an indigo open-width dyeing machine for dyeing cotton warps, which has a total capacity of 3,500 1 (including pipework and circulation tank), a dyeing vat is prepared in the following composition:

| | | |
|---|---|---|
| 0.45 g/l | of C.I. Vat Blue 5 (C.I. 73065) = | 1.775 kg |
| 8 ml/l | of sodium hydroxide solution (32.5% strength) = | 28 1 |
| 3.6 g/l | of sodium dithionite = | 12.6 kg |
| 1 g/l | of a dispersant = | 3.5 kg |

(Sodium salt or condensation product of naphthalenesulfonic acid and formaldehyde)
Liquor temperature: 50° C.

The continuous dyeing process comprises dyeing 10 kg per minute of prewetted cotton yarn, squeezed off to a wet pickup of 60%, in 4 dip passages of 8 s each and squeezing off to 90% wet pickup with a subsequent air passage of 60 s each.

About 0.5% of the dye becomes fixed on the yarn and has to be continuously replaced to avoid depletion of the dyebaths; that is, 50 g of dye has to be replenished per minute. This amount of dye is continuously added as a dispersion in 1 liter Of water. This dye dispersion is continuously stirred at low speed.

At the same time the chemicals required for vatting the replenished dye and for dyeing are added separately, namely:

2 liters per minute of the chemical liquor comprising 200 ml of sodium hydroxide solution (32.5% strength)

117 g/l of sodium dithionite 5 g/l of the dispersant

The result is a brilliant blue dyeing having the desired properties of minimal penetration (ring dyeing) and hence an easy wash down.

EXAMPLE 2

To dye color denim warps with vat dyes in indigo open-width dyeing machines, the procedure is as follows:

In a dyeing trough a dyeing vat is prepared with for example 12 g/l of C. I. Vat Orange 2 (C. I. 59705)

40 ml/l of sodium hydroxide solution (32.5% strength)

0.5 g/l of anthraquinone powder 18 g/l of sodium dithionite, a temperature of 60° C. is set, and the vat is left to stand for 5 minutes for vatting. A cotton warp which has been prewetted and dewatered to a 60% wet pickup is then dyed therein for 10 seconds. Thereafter it is squeezed off to a 100% wet pickup, oxidized in air for 1 minute, rinsed and soaped.

If, as in Example 1, 10 kg per minute of prewetted cotton yarn are dyed, the fixed dye and the vatting and dyeing chemicals have to be replenished:

2 liters per minute with 60 g/l of C. I. 59705 and 2 liters per minute of the chemical solution with:

150 ml/l of sodium hydroxide solution (32.5% strength)

7.5 g/l of sodium dithionite, and 2.5 g/l of anthraquinone powder.

The result is a minimally penetrated cotton yarn which has the wash down characteristics required for color denim.

We claim:

1. A process for continuously dyeing yarns with vattable dyes, which comprises:

in the continuous dyeing of yarn in a vat containing a circulating dye liquor comprising a dye in an aqueous medium containing a reducing agent, an alkali and a dispersant, metering a dispersion consisting essentially of said dye and water into the dye liquor.

2. The process of claim 1, wherein the dye has a vatting half life in the dye liquor of <20 minutes.

3. The process of claim 2, wherein said vatting half life is ≦5 minutes.

4. The process of claim 1, wherein said reducing agent is sodium dithionite, thiourea dioxide, another organic reducing agent or mixtures thereof.

5. The process of claim 1, wherein dyeing is conducted at a temperature ranging from 20° to 90° C.

6. The process of claim 1, wherein said dye is C.I. Vat Blue 5, C.I. Vat Orange 2, C.I. Vat Blue 4, C.I. Vat Red 32, C.I. Vat Green 1, C.I. Vat Green 9 or Disperse Yellow 54.

7. The process of claim 1, which further comprises adding an aqueous liquor, which does not contain a dye component to said circulating dye liquor at the time the aqueous dispersion of dye in water is added to the circulating dye liquor.

8. The process of claim 1, wherein the dye in the dispersion added to the dye vat is in finely divided form.

* * * * *